United States Patent [19]

Kaiser

[11] 4,085,791

[45] Apr. 25, 1978

[54] METHOD OF PORE-FREE DIE CASTING

[75] Inventor: Willard D. Kaiser, Grove City, Ohio

[73] Assignee: International Lead Zinc Research Organization, Inc., New York, N.Y.

[21] Appl. No.: 652,121

[22] Filed: Jan. 26, 1976

[51] Int. Cl.[2] ..... B22D 27/20; B22D 17/04

[52] U.S. Cl. ..... 164/55; 164/113; 164/305; 164/318

[58] Field of Search ..... 164/113, 119, 133, 136, 164/303, 305, 309, 314, 315, 316, 317, 318, 55, 66, 67

[56] References Cited

U.S. PATENT DOCUMENTS

| | | | |
|---|---|---|---|
| 2,224,981 | 12/1940 | Morin | 164/316 |
| 2,243,835 | 6/1941 | Brunner et al. | 164/256 |
| 2,660,769 | 12/1953 | Bennett | 164/156 |
| 2,972,172 | 2/1961 | Federman | 164/113 |
| 3,019,495 | 2/1962 | Cornell | 164/62 |
| 3,123,875 | 3/1964 | Madwed | 164/113 X |
| 3,382,910 | 5/1968 | Radtke et al. | 164/113 X |
| 3,727,674 | 4/1973 | Chatourel et al. | 164/119 X |
| 3,744,546 | 7/1973 | Miki et al. | 164/55 |
| 3,752,213 | 8/1973 | Miki | 164/113 |
| 3,779,304 | 12/1973 | Miki | 164/55 X |
| 3,791,440 | 2/1974 | Cross | 164/113 |
| 3,814,170 | 6/1974 | Kahn | 164/80 X |

OTHER PUBLICATIONS

Mitamura et al., "Method of Replacing Air Inside the Nozzle of a Hot Chamber Die Casting Machine with Active Gas," Toshiba Machine Co. Inc.; Public Patent Bulletin, 2/14/1974.

Kaiser, W. D. et al., "Design of a Servo Injection System for Die Casting," The Society of Die Casting Engineers, Inc., Paper No. 52, 1970.

Die Casting: Pore-Free Die Casting, *Machine And Production Engineering*, vol. 121, No. 3115, 7/26/1972, pp. 129–134.

*Primary Examiner*—Francis S. Husar
*Assistant Examiner*—Gus T. Hampilos
*Attorney, Agent, or Firm*—Brumbaugh, Graves, Donohue & Raymond

[57] ABSTRACT

In a hot chamber method of pore-free die casting in which a reactive gas flushes non-reactive gas such as air from a die before a material is cast therein, the material displaces non-reactive gas from the gooseneck and nozzle through which the die is filled before the reactive gas flushes the die. The material then does not push non-reactive gas into the die as it fills the die. Apparatus for practicing the method comprises servo-control means for filling the gooseneck and nozzle with the material before the reactive gas flushes the die to displace non-reactive gas therefrom and then filling the die with the material after the reactive gas has flushed the die.

6 Claims, 3 Drawing Figures

METHOD OF PORE-FREE DIE CASTING

BACKGROUND OF THE INVENTION

This invention relates to die casting and more particularly to an improved method for hot chamber pressure die casting.

Die casting is a well known way of shaping articles in which a liquid material, such as molten metal, is placed in a cavity which is formed in the shape of the desired article between separable die members. The liquid material fills the die cavity and solidifies therein in the shape of the desired article. The die members are then separated and the article removed from the die cavity. In pressure die casting, the liquid material is forced or injected into the die cavity under pressure.

Although die casting is a relatively easy way of forming articles, particularly articles having complex exterior surfaces which otherwise would be difficult to form, pores often form throughout the casting to significantly weaken the cast article. Such weak, porous articles are not suitable for many applications and articles for these applications have had to be manufactured by other, more expensive techniques.

Even though die casting and the problems presented by the porosity of cast articles have been long known, it was not until U.S. Pat. No. 3,382,910 issued on May 14, 1968 in the names of Radtke and Eck that a novel way of avoiding pores in cast articles became known. This patent, which is assigned to the same assignee as this application, describes a method of pore-free die casting in which the die cavity is purged of air (or other non-reactive gas or vapor) with a gas which reacts with the material to be cast in the die cavity. Such gas is herein called a reactive gas.

When the material is then cast, the reactive gas in the die cavity reacts with the materials to form solid compounds therewith rather than the pores or bubbles which the non-reactive components of air in the die cavity would have formed in the cast article. For example, the patent describes flushing the die cavity with oxygen which reacts with a molten metal as it is cast in the die cavity to form small particles of oxides of the cast metal rather than pores or bubbles of trapped non-reactive gas.

Even though the practice of the method described in U.S. Pat. No. 3,382,910 produced articles which were significantly more pore-free than articles produced by conventional die casting, it has been found that some pores continue to be formed in articles cast according to the patented method in which only the die cavity is purged.

One attempt to control the formation of pores produced in cast articles suggests that portions of the article which first solidified shrank from still liquid portions of the material to form pores in the article. It then proposes to control, but not eliminate, the formation of such pores by controlling the places at which the cast article first cools and solidifies in the die cavity so that the pores from shrinkage of the material are formed in a portion of the cast article which can tolerate weakness from the pores or which may be removed from the finished article.

A proposal for further reducing the pores in an article cast in a die cavity which is filled with a reactive gas suggests placing a constricted gate at the place where the material enters the die cavity. The constricted gate produces a turbulence in the material injected into the die cavity to mix the injected material more completely with the reactive gas in the die cavity. Even if this proposal is more successful in reacting the gas with the material, it alone does nothing to eliminate non-reactive gas which may be injected into the die cavity with the material. Such non-reactive gas in the die cavity then forms pores in the cast article in the same way as if the die cavity has not been purged with the reactive gas before casting the material.

Two types of die casting apparatus are known. One type, often and herein called cold chamber apparatus, has a chamber just large enough to fill the die cavity once. This chamber is generally open to receive the individual shots of material to be cast. The open chamber can be easily flushed with a reactive gas (along with the die cavity), so that non-reactive gas is not forced into the die cavity ahead of the material to form pores in the casting.

The other type of die casting apparatus, often and herein called hot chamber apparatus, however, has a chamber or furnace holding a continuous supply of the material to be cast. This chamber is connected to the die cavity by an enclosed passage for filling the cavity for successive castings. Inasmuch as the passage is enclosed and blocked at one end by the supply of material to be cast, it cannot be readily flushed with reactive gas.

Flushing the die cavity with a reactive gas merely traps non-reactive gas in the passage between the cavity at one end and the material at the other. Filling the die cavity then forces the non-reactive gas into the die cavity where it forms pores in the casting.

Opening the passage so that it could be flushed like cold chamber apparatus cannot be done because the material would then escape through the opening as it fills the die cavity. In cold chamber apparatus, a plunger usually pushes the material away from the opening as it forces the material into the die. In hot chamber apparatus, however, a plunger which pushes the material along the portion of the passage in which non-reactive gas is trapped (a gooseneck, nozzle and sprue bushing, as later described) would not reach the passage to push the material away from an opening for flushing the passage. Indeed, the plunger would push the material toward and out of such an opening. For these and other reasons, the same techniques with which cold chamber apparatus is purged are not suitable for hot chamber die casting apparatus.

A proposal which, for the first time, permits the die cavity as well as the gooseneck, nozzle and sprue bushing of hot chamber apparatus to be purged of non-reactive gas is disclosed in copending U.S. patent application Ser. No. 659,426, filed Feb. 19, 1976, now U.S. Pat. No. 3,999,593 and assigned to the same assignee as this application. This method purges an enclosed passage for filling a die such as a sprue bushing, nozzle and at least a portion of a gooseneck at the same time as the reactive gas purges the die cavity. Apparatus for this method has a bore communicating with the passage and at least one opening communicating with the die cavity for passing the reactive gas therebetween to flush air or other non-reactive gas and vapor from the die cavity and passage before the material is cast. A valve closes the bore while the material is injected into the die so that the material does not escape through the bore. This method and hot chamber apparatus is different from the method and apparatus described herein, but as later described, may particularly cooperate with the method and apparatus described herein.

SUMMARY OF THE INVENTION

It is an object of the invention to provide a method and apparatus for casting articles with greatly reduced porosity in a hot chamber die casting machine which is, more particularly, applicable to die casting zinc alloys.

The invention will be described with reference to one hot chamber pressure die casting apparatus for injecting molten metal into a die cavity. This apparatus has separable die members which are pressed together to form a substantially closed die cavity between the members. The die cavity is filled with molten metal through enclosed means which comprise a runner system and sprue bushing extending through the die to the die cavity, a gooseneck, and a hollow nozzle which communicates at one end with the sprue bushing and at the other end with the gooseneck. The gooseneck curves downwardly from the nozzle into a holding furnace full of molten metal and upwardly in the furnace to form a chamber for a plunger which injects the molten metal into the die cavity. A bore at the upper end of the chamber, but initially below the plunger, admits molten metal from the furnace into the chamber. Downward movement of the plunger then closes the bore and injects the metal from the chamber through the gooseneck, nozzle, and sprue bushing into the die cavity. A shot cylinder drives the plunger downwardly in the chamber until the cavity (chamber) is full. Pressure then builds up and stops the travel. This pressure is maintained until the molten metal solidifies. The shot cylinder then returns the plunger to a position above the bore into the chamber for again filling the chamber through the bore.

In the method of the invention, the material to be cast fills the gooseneck and nozzle with the material to displace air and other non-reactive gas and vapor from the gooseneck and nozzle before (or while) a reactive gas flushes non-reactive gas from the die cavity. Since the material and not non-reactive gas then fills the passage to the die cavity, only the material will be injected into the die cavity.

The die cavity may be purged or flushed of non-reactive gas by passing the reactive gas between openings at opposite ends of the die cavity. Displacing non-reactive gas from the gooseneck and nozzle before the die cavity is purged substantially prevents non-reactive gas from being forced into the die cavity ahead of the material as the material fills the die cavity. Only the material and the reactive gas is then in the die cavity as the material is cast. The reactive gas reacts with the material in the die cavity to form particles of a solid compound therewith, rather than the pores or bubbles which non-reactive gas would have formed in the cast material.

Satisfactory operation of the method does not require that the entire passage to the die cavity be filled with the material. For example, the sprue bushing and the tip of the nozzle at the sprue bushing may not be filled with the material to prevent it fromm prematurely spilling into the die cavity. (The nozzle should also be inclined downwardly toward the gooseneck to further prevent premature filling of the die cavity.) The flow of reactive gas through the die cavity will then circulate somewhat through the open space at the sprue bushing to substantially purge it of non-reactive gas as it purges the die cavity. Further, even if some non-reactive gas were to remain in a portion of the nozzle, this portion of the nozzle may be made sufficiently small so as to hold insufficient non-reactive gas to form an undesirably large number of pores in the casting.

The step of displacing non-reactive gas from the gooseneck and nozzle is described as occurring before the reactive gas purges the die cavity. It will be readily understood from the description of the invention that this step may be carried out, in fact, entirely before or at least in part while the reactive gas purges the die cavity so long as the non-reactive gas which is displaced from the gooseneck and nozzle into the die cavity is purged therefrom by the reactive gas along with the non-reactive gas originally in the die cavity. The term "before" is thus used herein in the sense of not after completion of purging of the die cavity with the reactive gas.

Apparatus for carrying out the method comprises means for displacing non-reactive gas from the gooseneck and nozzle with the material to be cast. Further means then purge the die cavity (and possibly an end portion of the nozzle) with the reactive gas. For example, in the apparatus described above, servo-control means may cause the plunger to move downwardly in the chamber sufficiently to substantially fill at least the gooseneck and nozzle with the material. The plunger may then dwell in this position while a reactive gas purges the die cavity, and then continue its downward movement for injecting the material into the die cavity. A more sophisticated form of the apparatus which is later described in detail as an alternatively preferred embodiment includes a servo valve in parallel with a large solenoid valve. The servo valve slowly and precisely moves the plunger just enough to substantially fill the gooseneck and nozzle with the material and the solenoid valve later moves the plunger rapidly to inject the material into the die cavity.

Another later described, alternatively preferred embodiment illustrates the particular cooperation of the method and apparatus described herein with the method and apparatus described in the above mentioned U.S. Pat. No. 3,999,593. In this embodiment, the gooseneck is provided with a bore through which a reactive gas flows to flush non-reactive gas from the die cavity as well as from the portion of the gooseneck and nozzle between the die and the bore. The gooseneck passage is then filled only to the bore, the remaining portion of the gooseneck passage being purged of non-reactive gas by the reactive gas which flows through the bore. This arrangement has the advantage of separating the material from the die cavity while the die cavity is being purged with the reactive gas to more positively prevent premature spilling into the die cavity.

DESCRIPTION OF THE DRAWINGS

Preferred embodiments which are intended to illustrate but not to limit the invention will now be described with reference to drawings in which.

DESCRIPTION OF THE PREFERRED EMBODIMENTS FOR THE METHOD

Figure 1:
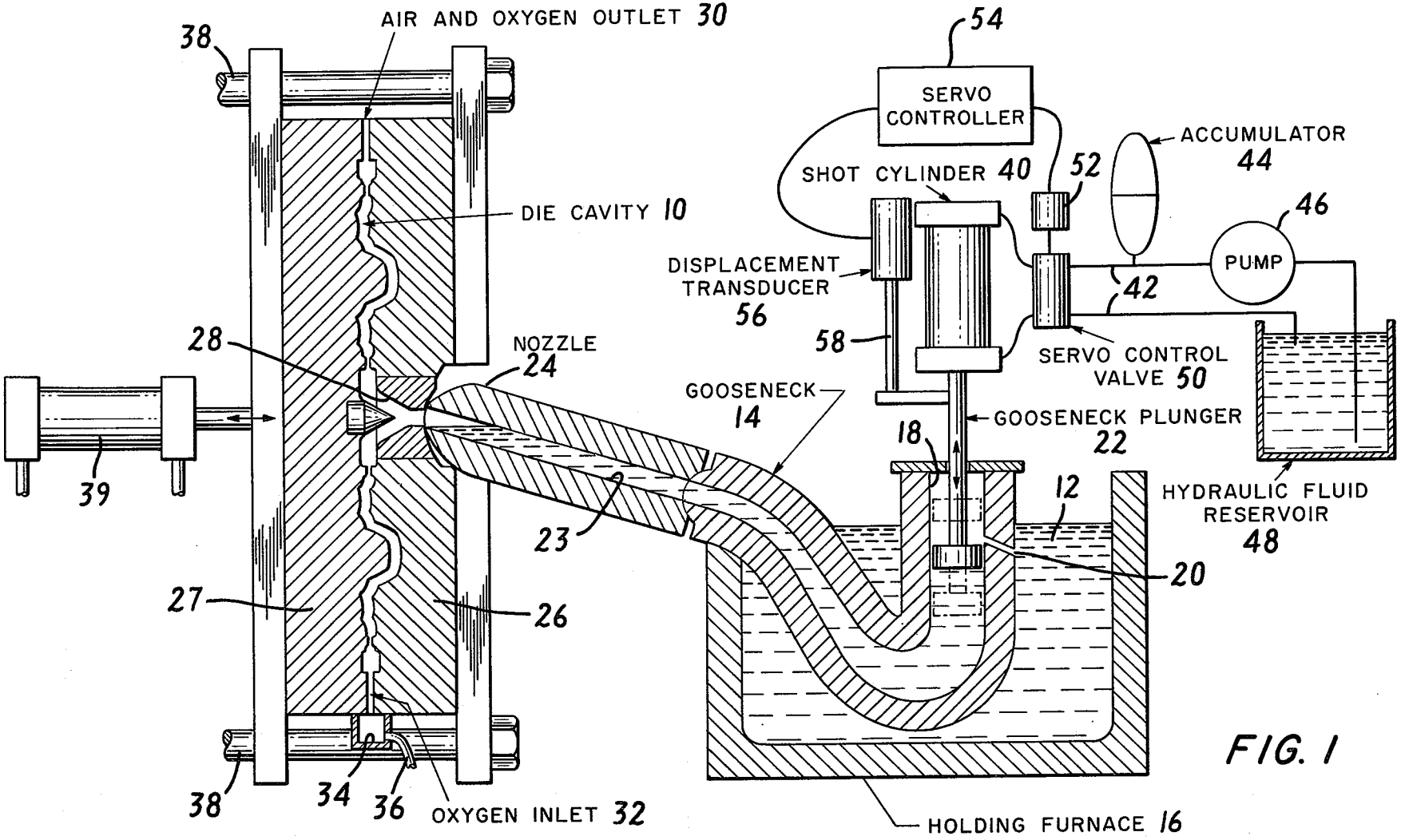
FIG. 1 is a schematic illustration, partly in cross section, of one preferred embodiment for practicing the method.

FIG. 1 shows one preferred embodiment for practicing the method. In this embodiment the means for filling a die cavity 10 with a liquid material such as molten metal 12 comprises a gooseneck 14 and nozzle 24 of the type more generally described above. The metal 12 is heated in a holding furnace 16 to form a continuous, molten supply.

The molten metal enters a generally vertical chamber 18 at one end of the gooseneck through a bore 20 which communicates between the chamber and the supply of molten metal in the holding furnace 16. A gooseneck plunger 22 is then in a position (shown in phantom) above the bore 20 to admit the metal to the portion of the chamber beneath the plunger. The plunger then moves downwardly in the chamber to the position shown in full to force the liquid metal through a passage 23 defined by the gooseneck and nozzle to a level at which the molten metal just reaches the end of the nozzle. The nozzle is inclined upwardly toward the sprue bushing 28 so that the molten metal then fills the passage in the gooseneck and nozzle to substantially displace all the air or other non-reactive gas from the passage.

The nozzle butts against a stationary die member 26 at the sprue hole or bushing 28 so that the passage 23 communicates with the sprue bushing. The sprue bushing communicates with the die cavity 10.

One end of the die cavity has an air and oxygen outlet 30. The air which is displaced from the passage 23 when the molten metal 12 fills the passage in the gooseneck and nozzle then displaces a like volume from the die cavity through the outlet 30.

The end of the die cavity remote from the air and oxygen outlet 30 has an oxygen inlet 32. The oxygen inlet communicates with a U-shaped chamber 34 which has sides which slidingly seal the open side of the chamber to die members 26 and 27 at the inlet 32. A tube 36 connects the chamber 34 with a supply of oxygen (or other reactive gas).

The die member 27 is movable and adapted to be slidingly separated from the stationary die member 26 along rods 38 by means such as a hydraulic cylinder 39. While the die members are separated from each other, a previously cast article may be removed from the die cavity. The hydraulic cylinder 39 then slides the movable die member 27 toward the stationary die member 26 to substantially close the die cavity. As the movable die member 27 approaches the stationary die member 26, it forms a sliding seal with the chamber 34 so that oxygen supplied to the chamber through the tube 36 begins to flow into the oxygen inlet (and between the die members) even before the die members are fully together. The oxygen flushes air (or other non-reactive gas or vapor) from the die cavity through the air and oxygen outlet 30.

At some selected time before the oxygen ceases to flow into the inlet 32, the gooseneck plunger 22 is caused to move to the position shown in full in FIG. 1 to displace air from the passage 23 with the material 12. The air forced from the passage 23 enters the die cavity and is forced from the die cavity by the oxygen flowing from the inlet 32. The inlet 32 is preferably at the bottom of the die to take advantage of residual heat from the die members which heats the air trapped in the die cavity, the heated air then tending to rise toward the oxygen outlet 30 at the opposite, top end of the die.

The described operations are preferably carried out simultaneously so as to minimize the time between castings. The sequence may be altered, however, without departing from the invention, so long as the passage 23 is substantially filled with the material before the oxygen ceases to flow through the die cavity.

The gooseneck plunger 22 then moves to the lowermost position (shown in phantom in FIG. 1) to force the molten metal from the passage 23 through the sprue bushing 28 into the die cavity 10. The extent of movement of the plunger is sufficient to inject enough molten metal into the die cavity to fill the die cavity and maintain pressure on the molten metal until it solidifies. Simultaneously, the reactive gas which replaced the air in the die cavity reacts with the molten metal to form particles of a solid compound (an oxide) therewith rather than the pores or bubbles which air or other non-reactive gas or vapor would form in the cast material. After the molten metal cools and hardens, the die members are separated to remove the pore-free casting from the die cavity.

THE SERVO CONTROL

The gooseneck plunger 22 is moved between the upper and lowermost positions by a shot cylinder 40. The shot cylinder is connected to fluid pressure lines 42. The fluid pressure lines extend from the shot cylinder to a pressure accumulator 44, a pressure pump 46, and an hydraulic fluid reservoir 48. A servo-control valve 50 opens and closes the lines to fluid flow. Suitable servo-valves are commercially available, one such valve being a Moog 79 series valve rated at 283 gal. per. min.

An electrical activator 52 for the servo control valve 50 is electrically connected to a servo controller 54. The servo controller is electrically connected to a displacement transducer 56. The displacement transducer has a rod 58 which is mechanically connected to the gooseneck plunger 22 for movement therewith.

Movement of the rod 58 with the gooseneck plunger 22 causes the displacement transducer to produce an electrical signal proportional to the extent of movement of the rod 58 and connected gooseneck plunger. Suitable displacement transducers are commercially available. Then, when the apparatus is to operate as indicated, a signal to a solenoid switch (not shown) in the servo controller may indicate that the die members 26 and 27 have come together. The servo controller then sends an electrical signal to the servo control valve activator 52 which operates the servo control valve 50 to admit pressure fluid to the shot cylinder 40 for moving the gooseneck plunger 22 downwardly from the uppermost position shown in FIG. 1.

As the gooseneck plunger moves downwardly, the electrical signal from the displacement transducer changes proportionally until the signal reaches a value which indicates (from prior volumetric calculation or even trial and error) that the gooseneck plunger has reached the position shown in full in which it has substantially filled the passage 23 with molten metal as shown in the FIG. 1.

If it is desired to provide a dwell time before filling the die cavity with the molten metal (for example, for continued purging of the die cavity with oxygen), this signal to the servo controller causes the servo controller to send a signal to the activator 52 to close the servo control valve 50. The gooseneck plunger then remains in the position shown in full until the servo controller sends a further signal to the servo control valve activator. The further signal may, for example, be produced by a timer (not shown) in the servo controller or by a signal to a solenoid switch (not shown) in the servo controller which indicates that it is appropriate to inject the molten metal into the die cavity.

The servo controller then sends another signal to the activator which again opens the servo control valve 50 for moving the gooseneck plunger to the lowermost position shown in FIG. 1. The plunger travels downward at a predetermined speed until motion is stopped by back pressure that develops when cavity is filled. It is important that pressure be maintained on the metal until it solidifies. The servo controller will then send a signal to the activator such that the servo control valve 50 reverses the fluid flow to cause the shot cylinder to raise the gooseneck plunger to the uppermost position for later repeating the described cycle of operation.

ANOTHER PREFERRED EMBODIMENT

Figure 2:
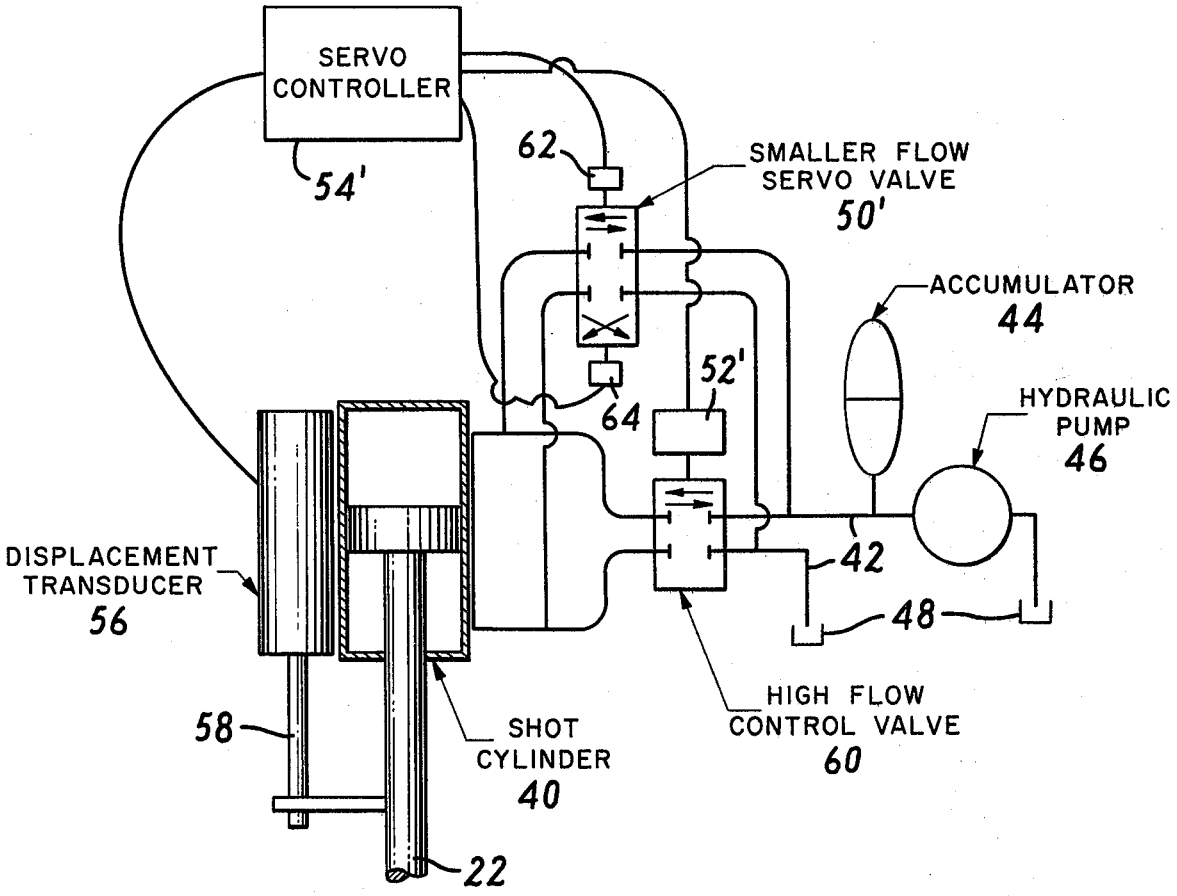
FIG. 2 is a schematic illustration of a portion of another preferred embodiment for practicing the method.

FIG. 2 schematically illustrates another embodiment in which the servo control for the gooseneck plunger 22 differs from that shown in FIG. 1. A solenoid operated control valve 60 (FIG. 2) has a high fluid flow capacity so as to provide rapid downward movement of the gooseneck plunger 22 as is known to be desirable for injecting the material into the die. A servo-valve for such rapid movement of the gooseneck would require use of a very large and fast response valve which is expensive. Solenoid valves with the same capacity are much less expensive.

To provide, therefore, both the rapid movement of the gooseneck plunger which is desirable for injecting the material into the die and slower movement of the gooseneck plunger for more precise control of its movement to displace air from the gooseneck, a servo valve 50' is connected to the fluid supply lines 42 in parallel with the large solenoid valve 60. The servo valve 50' has a smaller flow capacity than the valve 60 to more slowly pass fluid through the valve to the shot cylinder 40 when activated by a signal from controller 54' (as described for valve 50 in FIG. 1). The gooseneck plunger 22 then slowly moves downwardly to fill the passage in the gooseneck 14 and nozzle 24 with the material (as shown in FIG. 1).

When the plunger has moved sufficiently to fill the passage with the material, the displacement transducer 56 provides a signal proportional to this movement to servo controller 54'. The servo controller 54' then sends a signal to a servo control device 62 which closes the valve 50'. The servo controller 54' may then provide a dwell time (as described with reference to FIG. 1) and then send a signal to the solenoid valve activator 52' which opens the control valve 60. The high fluid flow through the control valve 60 then rapidly moves the gooseneck plunger for injecting the material into the die.

The servo valve 50' may also provide a slow return or upward stroke to the gooseneck plunger after injecting the material into the die as may be desired. For this purpose the servo controller 54' sends a signal to a servo control device 64 for moving the servo valve 50' to a position in which it cross-connects the fluid supply lines 42. The smaller fluid flow through the valve 50' is then reversed from its flow during movement of the gooseneck plunger for displacing air from the passage to slowly raise the gooseneck plunger. The described cycle of operation may then be repeated.

ANOTHER PREFERRED EMBODIMENT

Figure 3:
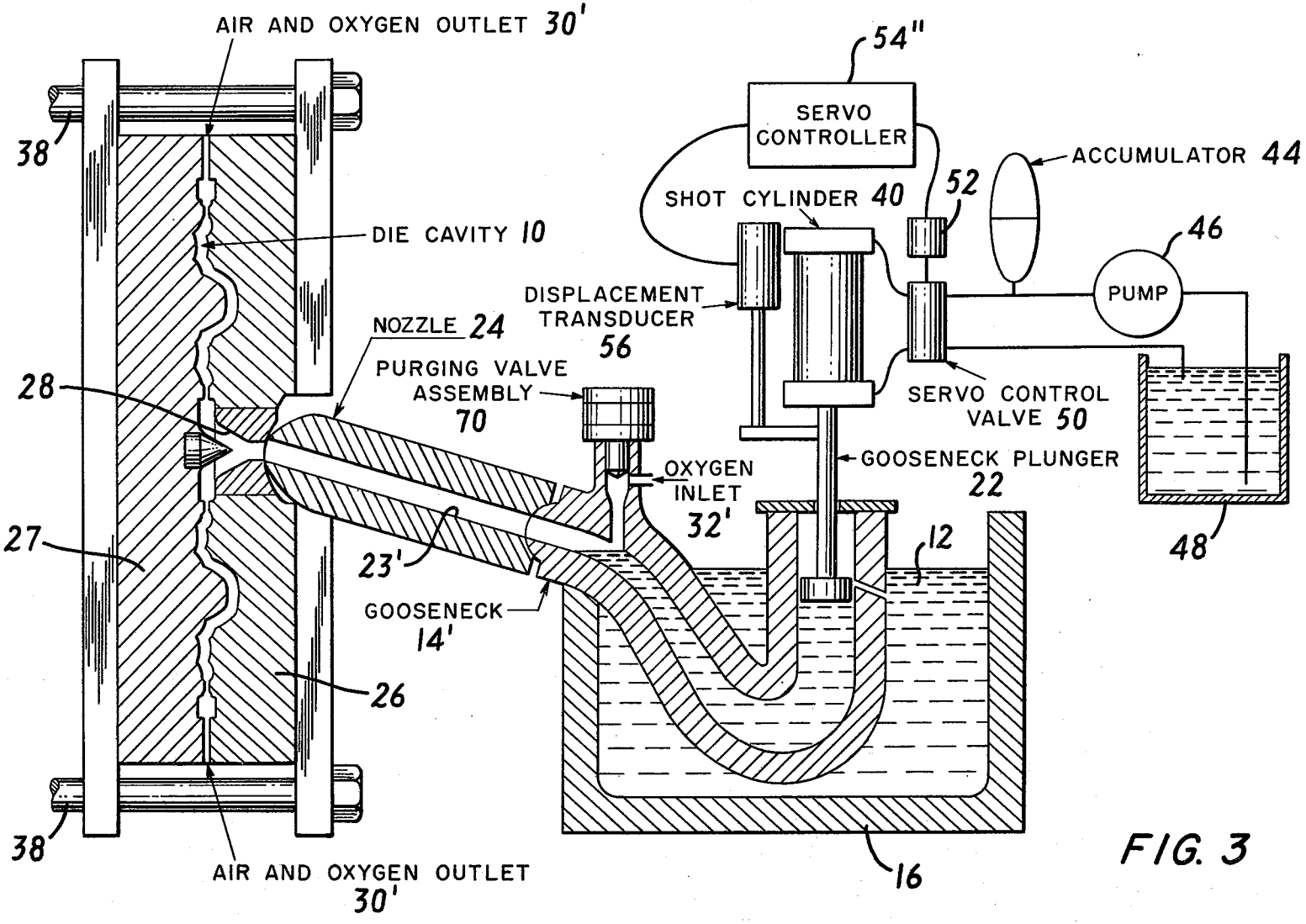
FIG. 3 is a schematic illustration, partly in cross section, of still another preferred embodiment for practicing the method.

FIG. 3 shows another preferred embodiment which is adapted to practice the method of the invention disclosed herein in combination with the method of the invention disclosed in the above-mentioned U.S. Pat. No. 3,999,593. In this embodiment an oxygen inlet 32' is formed as a bore into the passage 23' in a gooseneck 14'.

The displacement transducer 56 provides a signal proportional to the movement of the gooseneck plunger 22 to a servo controller 54'' such that the servo controller 54'' closes the servo controller valve 50 when the gooseneck plunger has substantially filled the passage 23' only to a level at the oxygen inlet 32'. Oxygen is then admitted to the inlet 32' to flush air from the remaining portion of the passage 23' and from the die cavity 10. The air and some oxygen then escape from the die cavity through air and oxygen outlets 30'. The air in the die cavity 10 and portion of the passage 23' to the oxygen inlet 32' is then replaced with the oxygen to react with the molten metal 12 as it is injected into the die cavity by the plunger with further control signals from the servo controller 54'' (just as described with reference to controller 54 in FIG. 1).

A purging valve assembly 70 closes the oxygen inlet 32' as the molten metal is injected into the die to prevent the molten metal from escaping along the oxygen inlet. Further details of one suitable purging valve assembly are disclosed in the copending application.

This embodiment improves that disclosed in FIG. 1 in that the molten metal is not raised to a position immediately adjacent the sprue bushing 28, but is separated therefrom substantially by the distance between the sprue bushing 28 and the oxygen inlet 32'.

With the embodiment shown in FIG. 1, it is clear that slight over filling of the passage 23 will permit the metal 12 to prematurely spill into the die cavity. Such premature spilling into the die cavity is undesirable because, for example, it may plug a portion of the die cavity to prevent subsequent purging or proper filling of the die cavity with the molten metal.

In the embodiment shown in FIG. 3, on the other hand, slight over filling of the passage 23' beyond the oxygen inlet 32' will not permit the molten metal to spill into the die cavity because the passage 23' is inclined. Reactive gas then admitted through the inlet 32' will still flow through the partially restricted inlet 32' (or even bubble through a bit of the material blocking the inlet 32') to purge the passage 23' and die cavity as before described. Also, this technique will provide faster and/or more complete purging than the method shown in FIG. 1 because there is no air entrapped in a dead space.

It is further possible to design the oxygen inlet 32' such that the embodiment shown in FIG. 3 more completely purges the passage 23' if the passage is filled with the material only to a level somewhat below that desired than the embodiment shown in FIG. 1 would purge passage 23 under the same conditions. If the passage 23 in the embodiment shown in FIG. 1 were filled with the metal 12 only to a level somewhat below that shown in the Figure, some of the air between the metal 12 and the sprue bushing 28 would still be purged by the reactive gas; however, such purging would only be by diffusion or eddies of the reactive gas into the space above the metal because the most direct flow path for the reactive gas extends from the inlet 32 to the outlet 30. On the other hand, in the embodiment shown in FIG. 3, the oxygen inlet 32' is directed toward the surface of the metal 12 in the passage 23'. If the metal is then at a level somewhat below that shown in the Figure, the reactive gas will still flow toward the metal as it enters the passage 23′ to purge air from the space above the metal.

The embodiment shown in FIG. 3 differs from that disclosed in the copending application because the level of the metal 12 is raised substantially to the oxygen inlet 32′ while the oxygen is purging the portion of the passage 23′ which extends to the die cavity. In this way, the oxygen inlet 32′ can be spaced along the gooseneck 14′ from the level of the metal 12 in the holding furnace 16 and still have the level of the metal in the passage 23′ substantially at the inlet 32′. By spacing the inlet 32′ from the level of the metal in the holding furnace the temperature at the inlet 32′ may be reduced somewhat from the high temperature at which the metal is maintained in the holding furnace. Less heat is thereby conducted toward the purging valve assembly 70 to desirably reduce the temperature at which the valve must operate. Further, it may be more convenient in the design of the apparatus to space the inlet from the holding furnace.

In addition to the embodiments described, other variations of the method and apparatus may occur to those skilled in the art. Such variations are contemplated as within the scope of the invention defined by the following claims.

I claim:

1. A method of reducing the pores formed in a material cast in a die cavity by the hot chamber process including a gooseneck and nozzle combination for filling the die cavity, the method comprising the steps of:

substantially displacing non-reactive gas from the gooseneck and nozzle combination with the material by filling at least a portion of the gooseneck and nozzle combination to a predetermined level with the material;

maintaining the material in the gooseneck and nozzle combination at said predetermined level while purging the die cavity with a reactive gas and thereafter until the die cavity is to be filled with the material; and filling the die cavity with the material through the gooseneck and nozzle combination whereby substantially no non-reactive gas is forced into the die cavity by the material as the material fills the die cavity, the reactive gas reacting with the material in the die cavity to form a solid compound therewith rather than the pores which non-reactive gas would have formed in the cast material.

2. A method as set forth in claim 1 wherein said predetermined level is such that the gooseneck and nozzle combination is substantially filled with the material before purging the die cavity with the reactive gas whereby the material displaces the non-reactive gas into the die cavity for purging from the die cavity with the reactive gas.

3. A method as set forth in claim 1 wherein said predetermined level is such that the gooseneck and nozzle combination is filled with the material only to an inlet for the reactive gas in the gooseneck; and additionally comprising the step of purging the portion of the gooseneck and nozzle combination between the inlet and the die cavity, as well as the die cavity, with the reactive gas.

4. A method as set forth in claim 1 wherein the steps of filling the gooseneck and nozzle combination to a predetermined level with the material and thereafter filling the die cavity with the material through the gooseneck and nozzle combination comprise moving a plunger within a chamber to a predetermined position so as to cause the gooseneck and nozzle combination to be filled to a predetermined level with the material, said chamber communicating with a supply of said material, said plunger being moved by means of a shot cylinder operatively associated with a servo control valve and servo controller means; and thereafter further moving said plunger within said chamber so as to cause the die cavity to be filled with the material, said plunger being further moved by means of said servo control valve and servo controller means.

5. A method as set forth in claim 1 wherein the steps of filling the gooseneck and nozzle combination to a predetermined level with the material and thereafter filling the die cavity with the material through the gooseneck and nozzle combination comprise moving a plunger within a chamber to a predetermined position so as to cause the gooseneck and nozzle combination to be filled to a predetermined level with the material, said chamber communicating with a supply of said material, said plunger being moved by means of a shot cylinder operatively associated with a servo control valve and servo controller means; and thereafter further moving said plunger within said chamber so as to cause the die cavity to be filled with the material, said plunger being further moved by means of a second valve operatively positioned parallel to said servo control valve, said servo control valve having a smaller fluid flow capacity than the second control valve, said further movement thereby being at a greater speed than the initial movement to said predetermined position.

6. A method as set forth in claim 5 wherein said second control valve is a solenoid valve.

* * * * *